United States Patent [19]

Finkel

[11] 4,290,217

[45] Sep. 22, 1981

[54] LIST FINDER

[75] Inventor: Henry Finkel, Westmount, Canada

[73] Assignee: Swedish Industrial Corporation of Canada Ltd., Montreal, Canada

[21] Appl. No.: 81,247

[22] Filed: Oct. 2, 1979

[51] Int. Cl.[3] ..... B42F 17/20

[52] U.S. Cl. ..... 40/389; 40/393; 402/72

[58] Field of Search ..... 40/389, 390, 393, 336; 402/60, 68, 70, 71, 72

[56] References Cited

U.S. PATENT DOCUMENTS

| | | | |
|---|---|---|---|
| 2,907,584 | 10/1959 | Neilsen | 40/390 |
| 2,945,312 | 7/1960 | Book | 40/336 U |
| 3,192,658 | 7/1965 | McGurn | 40/389 |
| 3,835,560 | 9/1974 | Mori | 40/389 |
| 3,964,192 | 6/1976 | Nonaka | 40/389 |
| 4,170,423 | 9/1979 | Bourbon | 402/70 |
| 4,183,161 | 1/1980 | Mori | 40/389 |

*Primary Examiner*—G. E. McNeill
*Assistant Examiner*—G. Lee Skillington
*Attorney, Agent, or Firm*—Beveridge, DeGrandi, Kline and Lunsford

[57] ABSTRACT

A list finder, for example, a telephone index, is provided in which all of the main parts can be integrally moulded of plastic mostly by simple moulds which do not require undercut moulding; the only essential non-plastic parts being a hinge pin pivotally connecting a base and a cover, and a spring. The base has two spaced apart pedestals each of which has laterally spaced upwardly facing and downwardly facing hinge pin seats, with a clear space being provided below the downwardly facing hinge pin seat so that this can be moulded by a unitary mould member which also moulds the underside of the base. The cover includes a planar portion and two downwards projections having a central web and a cylindrically curved flange, the flanges being engageable in T-shaped slots in the sheets of the index. The web member has an upwardly facing hinge pin seat, and an aperture is provided above this seat and the flanges so that these can be moulded by a unitary mould member which also forms the top of the cover. A further feature of the invention is a catch mechanism which includes mounting means moulded integrally with the base, and a catch member which snaps onto the mounting means and which has a yieldable part which engages with an abutment surface on the mounting means to bias the catch member into the latching position.

14 Claims, 10 Drawing Figures

LIST FINDER

SUMMARY OF THE INVENTION

The present invention relates to a list finder, for example a telephone index, of the type having a base and a cover hingedly attached to the base, and in which a stack of sheets are held between the base and the cover and are selectively engaged and lifted by a sliding pointer on the cover. A catch mechanism is also provided at the side or end of the base opposite to the hinge for normally retaining the cover in place, the cover being biased to the open position by a spring.

Examples of list finders of this general type are shown in the following U.S. patents:

U.S. Pat. No. 2,115,537 issued Apr. 26, 1938 to Peter;
U.S. Pat. No. 2,521,407 issued Sept. 5, 1950 to Pollock;
U.S. Pat. No. 2,556,734 issued June 12, 1951 to Nein;
U.S. Pat. No. 2,785,489 issued Mar. 19, 1957 to Lannert;
U.S. Pat. No. 2,791,848 issued May 14, 1957 to Neilsen;
U.S. Pat. No. 3,061,963 issued Nov. 6, 1962 to Buckley;
U.S. Pat. No. 3,820,264 issued June 28, 1974 to Mori.

Most of these prior art list finders are fairly complex in construction and costly to manufacture. The present invention provides a list finder in which all of the main parts are moulded from plastics material, and in which most of these parts can be moulded in simple moulds without undercut moulding; i.e., they can be moulded by only two relatively movable mould parts. Specifically, both the base and cover of the list finder of this invention are mainly formed each of a single integrally moulded part which does not require undercut moulding. These parts are held together by a simple shaft or hinge pin which can be easily inserted when the parts are held together. The spring which normally urges the cover upwards from the base part can also be easily inserted. The catch mechanism which normally holds the cover in place on the base comprises a unitary moulded part which is a snap fit onto a mounting member which is integrally moulded with the base.

A particular feature of the invention is the manner in which integrally moulded parts are provided to hold the hinge pin in place relative to the base and the cover. In accordance with this aspect of the invention, both the base and cover comprise integrally moulded parts having hinge pin seats which include a normally downwardly facing seat on the moulded base part and a normally upwardly facing seat on the moulded cover part, the base part being formed with a clear space below the downwardly facing seat and the cover part being formed with a clear space above the upwardly facing seat, so that the downwardly facing seat of the base part can be moulded by a unitary mould member which also forms a bottom surface of the base part, and the upwardly facing seat of the cover part can be moulded by a unitary mould member which also forms a top surface of the cover part. The base and cover parts also include surfaces for holding the seats in contact with the hinge pin during relative pivotal movement of the parts.

The integrally moulded part of the base may include two spaced apart upstanding pedestals, each of these pedestals having one lateral portion having the downwardly facing hinge pin seat and another lateral portion having a normally upwardly facing hinge pin seat, all of the four seats of the two pedestals being aligned to locate positively the hinge pin.

Also, the integrally moulded part of the cover may include a planar portion and two downwards projections therefrom, each projection having one of said upwardly facing hinge pin seats. The downwards projections may include arcuately curved parts which partially surround the upwardly facing hinge pin seats and which have curved flanges capable of engaging in slots in sheets retained between the cover and base. The cover will normally have apertures which allow the moulding of the upwardly facing hinge pin seats and the upwardly facing surfaces of the flanges by a unitary mould member which also forms the top of the cover.

The integrally moulded parts of the base and cover normally include rectangular planar members which form the main body of the base and cover. The hinge connecting the base and cover may extend along either a short or a long side of the base and cover. Along the side of the index remote from the hinge is a catch mechanism for normally retaining the cover closed on the base against the force of an opening spring. This catch mechanism preferably comprises mounting means integrally moulded with the base part and a catch member pivotably carried by the mounting means, and which is preferably itself an integrally moulded part, the catch member being engageable as a snap fit on the mounting means. The catch member has a resilient part which acts against an abutment surface of the mounting means pivotably to bias the catch member to a latching position where a latch portion of the catch member engages the cover to hold the cover in position on the base part, the catch member being pivotable by finger pressure from the latch position to release the cover.

DESCRIPTION OF VIEWS OF DRAWINGS

The invention will further be described with reference to the accompanying drawings showing a preferred embodiment of the list finder, and in which:

FIG. 1 is a perspective view of the list finder,

FIGS. 2*a* and 2*b* are sectional elevations along lines 2—2 and 2*b*—2*b* of FIG. 1, FIG. 2*b* being an enlarged view of the hinge portion of the index, FIG. 3 is a cross-sectional view across the central area of the list finder, on lines 3—3 of FIG. 1, FIG. 4 is a cross-sectional view through the hinge portion of the list finder, on lines 4—4 of FIG. 1, FIG. 5 is an exploded, diagrammatic view of portions of the hinge mechanism, FIGS. 6 and 7 are sectional views on lines 6—6 and 7—7 of FIG. 1, showing the catch mechanism, FIG. 8 is a view similar to FIG. 7 but with the parts in a different position, and FIG. 9 is an exploded, perspective view of the catch mechanism.

DETAILED DESCRIPTION

Figure 1:
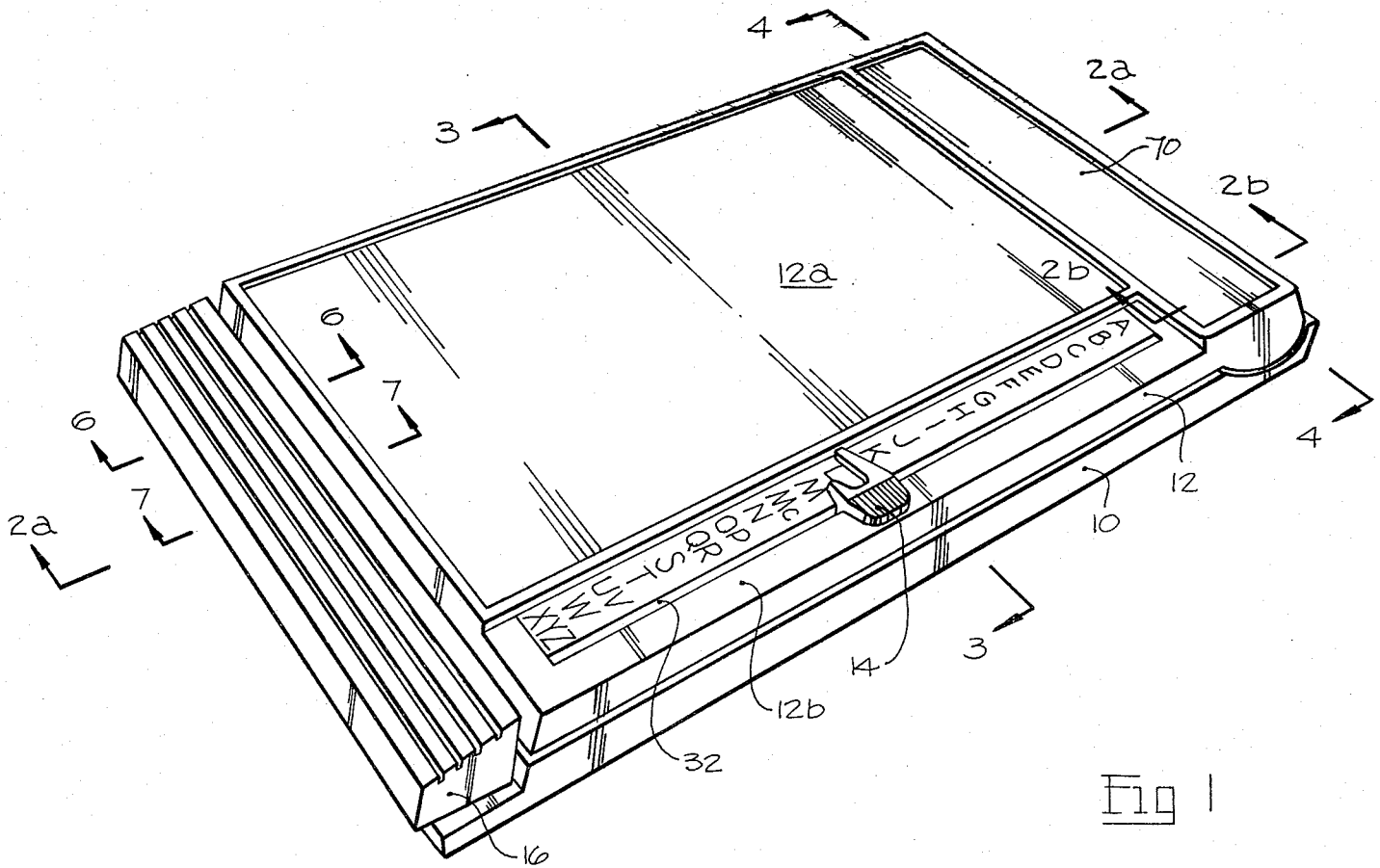
Figure 2A:
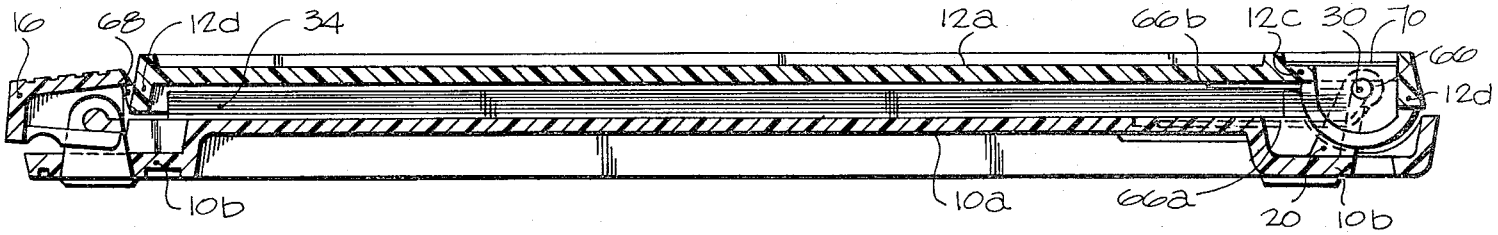
Figure 2B:
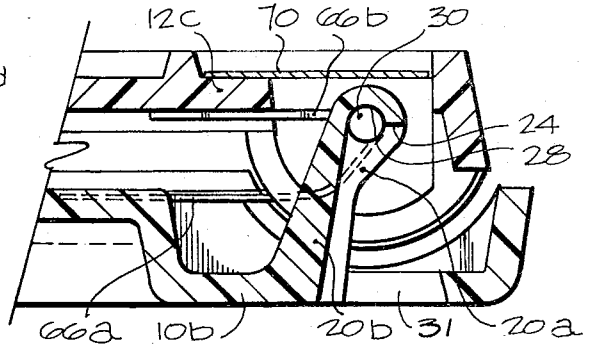
Figure 3:
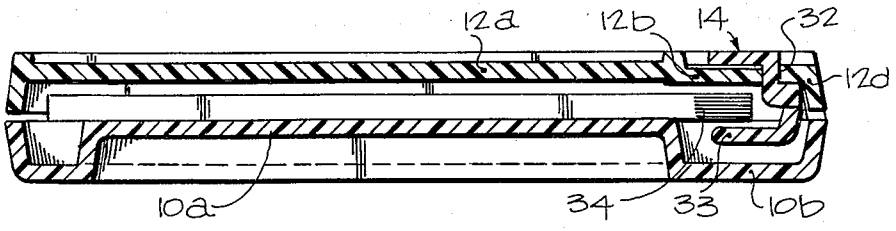

Referring especially to FIG. 1, the main components of the list finder are a base 10, a cover 12 hinged to the base by hinge means at the right hand end of FIG. 1 but which are obscured in this Figure, the cover having a slide member 14, and a catch member 16 at the end of the list finder opposite the hinge for releasing the cover from the base.

Figure 4:
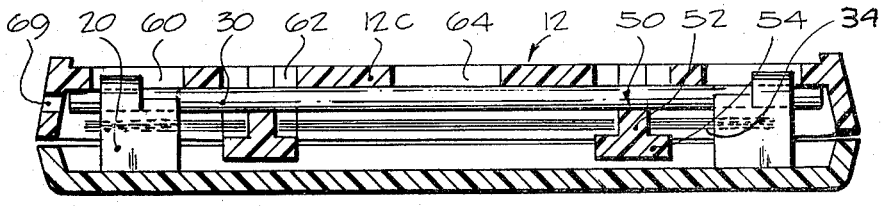
Figure 5:
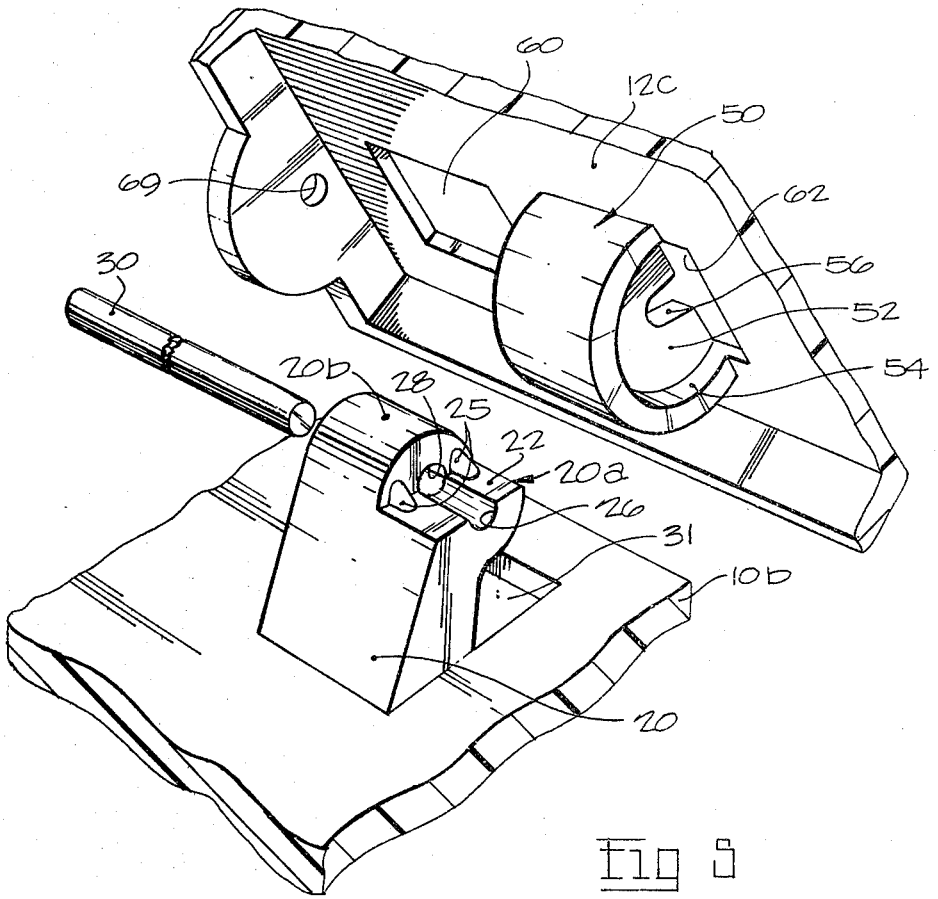

Referring more particularly to FIGS. 2 to 5, the base part 10 is an integrally moulded plastic part which includes a planar portion 10*a* surrounded by a sunken marginal area 10*b* which is of trough-shaped form on the hinge end of the index and along two of the longer sides, but is flat where it underlies the catch member 16. As best seen in FIGS. 2*b*, 4 and 5, the trough portion 10*b* of the base which underlies the hinge is provided with two upstanding pedestals 20 which slope upwardly away from the main part of the base towards the adjacent edge thereof. As seen in FIGS. 4 and 5, the upper part of each pedestal 20 has two lateral portions, namely an inner portion 20*a* having a generally flat upwardly facing surface 22, and an outer portion 20*b* which is higher than portion 20*a*, and the part of which nearest the edge of the base has a downwardly facing surface 24, best seen in FIG. 2*b*, which is co-planar with surface 22. Two small gussets 25 connect surfaces 22 to the sides of portion 20*b*. The surface 22 has an upwardly facing, semi-cylindrical hinge pin seat 26, which is axially aligned with a similar but downwardly facing hinge pin seat 28 formed in surface 24. The two pedestals 20 thus have between them two upwardly facing hinge pin seats and two downwardly facing hinge pin seats which are co-axially aligned and co-operate positively to locate a steel hinge pin 30.

The base part 10*b* below the pedestal 20 is apertured as at 31 to provide a clear space below the downwardly facing surfaces of the pedestal including seat 28. This allows these surfaces to be formed by a mould part which is unitary with a mould member which also forms the underside surfaces of the whole of the base. Accordingly, the pedestal construction shown does not require any undercut moulding.

The cover 12 is mainly an integrally moulded plastic part having a main planar portion 12*a* with a flat surface, a side recessed surface 12*b* (see FIG. 3), and a further recessed surface 12*c* above the hinge. All four sides of the cover are surrounded by a depending flange 12*d*.

The recessed area 12*b* is provided with a longitudinal slot 32 in which the slide member 14 is movable. This slide member is a plastic moulding having an outlining pointer movable along the outside of the cover to register with a series of letters or numbers provided on a narrow plate (not shown) adhered to surface 12*b*, and the member has a finger 33 spaced from the lower side of the cover such as to pass under the edges of a stack of sheets 34 held on the raised part 10*a* of the base, and is capable of lifting a proportion of these sheets with the cover in the conventional manner. The material of the cover is sufficiently flexible to allow slot 32 to be distorted for insertion of member 14.

At the hinge end of the cover there are provided two depending projections 50, each including a semi-circular web member 52 and a cylindrically curved flange member 54 surrounding the web member. As shown in FIG. 4, these parts provide a curved, T-shaped profile suitable for fitting within T-shaped slots at the end margins of the sheets 34, and which allows sheets not being raised with the cover to slide on this as it pivots open.

Each web member 52 has at its centre an upwardly facing hinge pin seat 56, of semi-cylindrical form. This is spaced sufficiently below the lower surface of planar part 12*c* to allow the hinge pin 30 to be retained between the seats 56 and this lower surface, as illustrated in FIG. 4. Accordingly, the hinge pin is positively located relative to the cover.

The portion 12*c* of the cover is provided with a series of five apertures. The two outer apertures 60 are positioned above the pedestals 20 to prevent interference between the cover and the pedestals. Two further apertures 62 are provided above the web member 52, and extending slightly laterally beyond the edges of flange member 54, the purpose of which is to allow the upwardly facing hinge pin seat 56, and the upwardly facing surfaces of the flange 54, to be moulded by parts of a unitary mould member which also moulds the upper surface of the cover. Accordingly, the cover can be moulded without any undercut moulding. The cover also has a central aperture 64 which can be used to position an opening spring 66 (shown in FIGS. 2*a* and 2*b*) which surrounds the hinge pin 30 and normally urges the cover upwardly from the base. Spring 66 is a coil spring having a lower leg 66*a* engaging in a groove in the base part 10*a* and an upper leg 66*b* which engages the cover. The cover also has a detent 68 engageable by catch member 16 (to be described) to hold the cover closed.

The cover also has a lateral hole 69 drilled through, or cam-action molded on one of the side flanges, which is almost aligned with but slightly below the installed position of hinge pin 30. This hole allows the hinge pin to be inserted with slight distortion of the flange, but when the hinge pin has been fully positioned as shown in FIG. 4 the normal position of the flange prevents its removal.

The area of the cover 12*c* which contains the apertures is covered by a thin metal or plastic plate 70 adhered in place.

Figure 9:
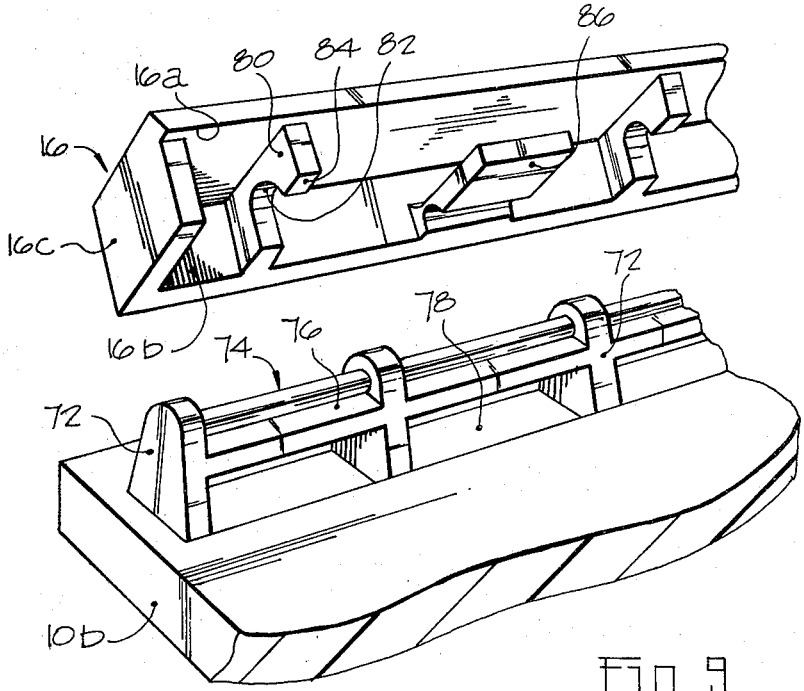

The catch mechanism which normally holds the cover in place includes mounting means shown in the lower part of FIG. 9 which are integrally moulded with the base, and the movable catch member 16.

Figure 6:
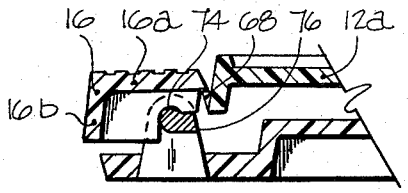
Figure 7:
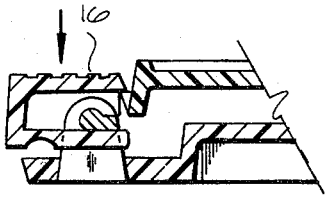
Figure 8:
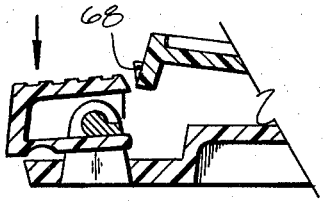

The mounting means include a series of vertical plates or pedestals 72 projecting upwardly from the sunken marginal area 10*b* at the end of the base remote from the hinge. The plates 72 carry a non-circular shaft 74 the cross-sectional shape of which is shown in FIGS. 6 to 8. The shaft includes a part-cylindrical surface which surrounds more than 180° of the shaft axis, and a rib 76 which extends from the shaft axis towards the hinge end of the base. This rib 76 has an upper surface spaced below the top of the shaft, and has a flat lower surface which blends with the cylindrical surface at the bottom of the shaft. Apertures 78 are provided between the plates 72 so that the lower surfaces of the shaft can be formed by a mould part unitary with mould parts forming the bottom of the base. The base of the shaft is situated above the top surface of the marginal area 10*b* of the base to allow insertion of a catch member part to be described.

The catch member 16 is a part integrally moulded from resilient plastic, such as a plastic of the acetyl resin type, and includes a ribbed top 16*a* the form of which is shown in FIG. 1, a rear flange 16*b*, and end gables 16*c* which close the ends of the catch member, as illustrated in FIG. 9. Two spaced ribs 80 joined to parts 16*a* and 16*b* are provided with recessed seats 82 which, as shown in FIG. 6, fit onto the top of the cylindrical portion of shaft 74. Outwardly beyond the seats 82 the ribs have horizontal surfaces 84 which are designed to mate with the upper surface of rib 76 when the catch member is horizontal as shown in FIG. 6. Also moulded with the catch member is a resilient tongue 86 connected to the rear flange 16*b* by a narrow web so as to be relatively flexible. The tongue is sufficiently flexible to allow the catch member to be snapped into place on the shaft 74, and such that when the catch member is in place the upper surface of the tongue is in tight contact with the abutment surface provided by the rib 76 so that these parts urge the catch member into the normal horizontal position as shown in FIG. 7, which is the latching position where a front, latch portion of the member engages detent 68. The catch member projects rearwardly from the shaft so that finger pressure applied thereto, as illustrated by the arrow in FIG. 8, causes the catch member to pivot with bending of the tongue 86 so as to release the detent 68. The design is such that the width of the web joining the tongue to the flange 16*b* can readily be adjusted to give the required resiliency.

It will be appreciated that the list finder as described can be assembled very easily, by positioning the cover on the base and firstly inserting the hinge pin 30 through the hole 69, through the hole provided in the first pedestal 20 by the oppositely facing bearing surfaces 26 and 28, across the hinge seat 56 of the first of the cover projections, and then putting in place the spring 66 which is inserted through the top aperture 64 of the cover. The hinge pin 30 is then further inserted across the next hinge seat 56 and through the next pedestal 20, and then pushed completely through the hole 69 so that it is self-retaining. The plate 70 is then secured to the top surface 12*c* of the cover, and slide member 14 inserted in slot 32. The catch member 16 is snap fitted into place on the shaft 74,76. Of the moulded parts, the only one which requires any undercut moulding is the catch member 16, this being required by the notch in the tongue member 86.

I claim:

1. A list finder comprising a base and a cover pivotably connected together by a hinge pin with the cover normally lying above said base and defining therewith a space for index sheets, said cover incorporating means for lifting selected index sheets when the cover is opened, wherein said base and cover both comprise integrally moulded parts having hinge pin seats including a normally downwardly facing seat on said moulded base part and a normally upwardly facing seat on said moulded cover part, said base part having a clear space below said downwardly facing seat and said cover part having a clear space above said upwardly facing seat whereby said base part is capable of being formed by moulding by a unitary mould member which both forms a bottom surface of said base part and also forms said downwardly facing seat, said cover part having a configuration which is mouldable by a unitary mould member which both forms a top surface of said cover part and also forms said upwardly facing seat, said base and cover parts also including moulded surfaces for holding said seats in contact with the hinge pin during relative pivotal movement of the parts.

2. A list finder according to claim 1, wherein said surfaces for holding the seats in contact with the hinge pin include surfaces of said parts adjacent to said seats and which are oppositely facing relative to said adjacent seats so as to contact sides of the hinge pin opposite to those in contact with the adjacent seats.

3. A list finder according to claim 1 or claim 2, wherein said integrally moulded base part includes two of said downwardly facing hinge pin seats which are spaced apart, and said integrally moulded cover part includes two of said upwardly facing hinge pin seats which are spaced apart and which are positioned between said hinge pin seats of the base part.

4. A list finder according to claim 1, wherein said base part includes two spaced apart upstanding pedestals, each of said pedestals having one lateral portion carrying said downwardly facing hinge pin seat and another lateral portion having a normally upwardly facing hinge pin seat, all of said seats being aligned to locate positively the hinge pin.

5. A list finder according to claim 1, wherein said cover part includes a planar portion extending over the major part of said area of said base, said cover part including a slot for receiving a slidable index member which member constitutes said means for lifting selected sheets.

6. A list finder according to claim 1, wherein said moulded cover part includes a planar portion and two downwards projections therefrom, said projections each carrying one of said upwardly facing hinge pin seats.

7. A list finder according to claim 1, further comprising a catch mechanism remote from the hinge pin for normally retaining the cover closed on the base, said catch mechanism comprising mounting means integrally moulded with the base part and a catch member pivotably carried by said mounting means, said catch member being engageable as a snap fit on said mounting means, the catch member having a resilient part which acts against an abutment surface of the mounting means pivotably to bias the catch member to a latching position where a latch portion of the catch member engages the cover to hold the cover in position on the base part, said catch member being pivotable by finger pressure from said latch position to release the cover.

8. A list finder comprising a base and a cover pivotably attached by a hinge pin to the base with the cover normally lying above said base and defining therewith a space for index sheets, said cover incorporating means for lifting selected index sheets when the cover is opened wherein:

said base includes an integrally moulded part having two spaced apart upstanding pedestals, each of said pedestals having one lateral portion with a normally downwardly facing hinge pin seat and another lateral portion having a normally upwardly facing hinge pin seat, all of the seats of said pedestals being aligned to locate the hinge pin, said integrally moulded part including an open space under said downwardly facing seat whereby said base part is capable of being formed by moulding by a unitary mould member which also forms a bottom surface on said integrally moulded base part, and said cover includes an integrally moulded part having means pivotably engageable on said hinge pin.

9. A list finder according to claim 8, wherein said integrally moulded part of the base includes a planar portion surrounded by a sunken marginal area, and wherein said pedestals upstand from the sunken marginal area at one side of said planar member.

10. A list finder comprising a base and a cover pivotably connected together by a hinge pin with the cover normally lying above said base and defining therewith a space for index sheets, said cover incorporating means for lifting selected index sheets when the cover is opened, wherein said cover includes an integrally moulded part having a planar portion and two downwards projections therefrom, said projections each including an arcuately curved web which partially surrounds an upwardly facing hinge pin seat engaging said hinge pin, said web having curved flanges capable of engaging in T-shaped slots in said index sheets, said cover part having spaces above said hinge pin seats and flanges whereby both said seats and flanges are suitable for moulding by a unitary mould member which also forms a top surface of said cover part.

11. A list finder comprising a base and a cover connected by hinge means with the cover normally lying above said base and defining therewith a space for index sheets, said cover incorporating means for lifting selected index sheets when the cover is opened, and having a catch mechanism remote from the hinge means for normally retaining the cover closed on the base, the catch mechanism comprising mounting means integrally moulded with the base and a catch member pivotably carried by said mounting means, said catch member being engageable as a snap fit on said mounting means, the catch member having a resilient part which acts against an abutment surface of said mounting means pivotably to bias the catch member to a latching position where a latch portion of said catch member engages the cover to hold the cover against the base, said catch member being pivotable by finger pressure from the latch position to release the cover.

12. A list finder according to claim 11, wherein said mounting means includes a shaft and said catch member includes bearing surfaces pivotable on said shaft, said shaft being part cylindrical and including a non-cylindrical part forming said abutment surface.

13. A list finder according to claim 12, wherein said part cylindrical surface surrounds more than 180° of the shaft axis, and said non-cylindrical surface is a lateral extension from said cylindrical surface, wherein said catch member includes a part cylindrical bearing surface pivotable on said shaft, and wherein said resilient member is arranged to contact said abutment surface to bias the catch member to the latching position, and is yieldable both to allow the catch to be pivoted to the release position and to allow the catch to be positioned on the mounting means as a snap fit.

14. A list finder according to claims 11 or 13, wherein said mounting means includes pedestals upwardly extending from a main portion of said integrally moulded base part, and which carry said shaft, and wherein said base part includes a space allowing unobstructed access to the underside of said shaft so that this underside is suitable for moulding by a unitary mould member which also moulds an underside surface of the base part.

* * * * *